US009127458B2

(12) United States Patent
Donnelly et al.

(10) Patent No.: US 9,127,458 B2
(45) Date of Patent: Sep. 8, 2015

(54) COLLAPSIBLE ROOF TRUSS ASSEMBLY AND METHOD

(71) Applicant: Suncast Technologies, LLC, Palm Beach Gardens, FL (US)

(72) Inventors: Brian C. Donnelly, Naperville, IL (US); William J. Phillips, Batavia, IL (US); Michael R. Vogler, Oswego, IL (US); Stephen Whitehead, Elgin, IL (US)

(73) Assignee: Suncast Technologies, LLC, Palm Beach Gardens, FL (US)

( * ) Notice: Subject to any disclaimer, the term of this patent is extended or adjusted under 35 U.S.C. 154(b) by 0 days.

(21) Appl. No.: 14/214,386

(22) Filed: Mar. 14, 2014

(65) Prior Publication Data

US 2014/0260062 A1 Sep. 18, 2014

Related U.S. Application Data

(60) Provisional application No. 61/801,141, filed on Mar. 15, 2013.

(51) Int. Cl.

| | |
|---|---|
| ***E04B 1/343*** | (2006.01) |
| ***E04B 7/16*** | (2006.01) |
| ***E04C 3/11*** | (2006.01) |
| *E04C 3/00* | (2006.01) |
| *E04C 3/04* | (2006.01) |

(52) U.S. Cl.

CPC ..... *E04C 3/11* (2013.01); *E04B 1/34384* (2013.01); *E04B 7/163* (2013.01); *E04C 3/005* (2013.01); *E04C 2003/0491* (2013.01); *Y10T 29/49625* (2015.01)

(58) Field of Classification Search

CPC ..... E04C 3/02; E04C 3/04; E04C 3/11; E04C 2003/0491; E04C 3/005; E04B 1/34384; E04B 1/34326; E04B 7/16; E04B 7/163; E04B 7/166

USPC ..... 52/92.1, 92.2, 93.1, 641, 645, 646

See application file for complete search history.

(56) References Cited

U.S. PATENT DOCUMENTS

| | | | | |
|---|---|---|---|---|
| 1,870,491 | A * | 8/1932 | Church | 52/277 |
| 1,936,571 | A | 10/1932 | Bumann | |
| 2,150,217 | A * | 3/1939 | Gettelman | 52/72 |
| 2,461,916 | A * | 2/1949 | Omar | 52/71 |
| 2,541,784 | A * | 2/1951 | Shannon | 52/92.2 |
| 2,642,825 | A * | 6/1953 | McElhone et al. | 52/641 |
| 3,222,829 | A * | 12/1965 | Bening | 52/92.2 |
| 3,729,877 | A * | 5/1973 | Hall | 52/109 |
| 3,760,550 | A * | 9/1973 | Mueller et al. | 52/641 |
| 3,785,108 | A * | 1/1974 | Satchell | 52/645 |
| 3,866,381 | A | 2/1975 | Eschbach et al. | |
| 4,557,091 | A | 12/1985 | Auer | |
| 4,570,392 | A | 2/1986 | Oltman et al. | |
| 4,831,807 | A * | 5/1989 | Bolt | 52/641 |
| 4,986,037 | A | 1/1991 | Jackson, Jr. | |
| 5,036,634 | A | 8/1991 | Lessard et al. | |
| D371,208 | S | 6/1996 | De Zen | |
| 5,619,826 | A | 4/1997 | Wu | |
| 5,682,622 | A | 11/1997 | Tagg | |
| 5,778,604 | A | 7/1998 | Snow | |

(Continued)

*Primary Examiner* — Rodney Mintz

(74) *Attorney, Agent, or Firm* — McHale & Slavin, P.A.

(57) ABSTRACT

The present invention involves the provision of a truss assembly and method which includes components that have segments pre-connected in a manner that allows the connected parts to be collapsed for packaging and shipping with the other components of a shed or the like.

11 Claims, 5 Drawing Sheets

(56) References Cited

U.S. PATENT DOCUMENTS

| | | | | |
|---|---|---|---|---|
| 5,819,492 | A * | 10/1998 | Konicek | 52/641 |
| 5,901,522 | A * | 5/1999 | Slater | 52/641 |
| 5,950,392 | A * | 9/1999 | Short et al. | 52/690 |
| 6,099,092 | A | 8/2000 | Uffner et al. | |
| 6,115,971 | A | 9/2000 | Loebertmann et al. | |
| 6,145,254 | A | 11/2000 | Silva | |
| 6,250,022 | B1 | 6/2001 | Paz et al. | |
| 6,418,672 | B1 | 7/2002 | Hampel | |
| 6,581,337 | B1 | 6/2003 | Skov et al. | |
| 6,604,328 | B1 | 8/2003 | Paddock | |
| 6,634,152 | B1 * | 10/2003 | Pilkinton | 52/641 |
| 6,701,678 | B1 | 3/2004 | Skov et al. | |
| 6,796,087 | B1 | 9/2004 | Greene | |
| 6,892,497 | B2 | 5/2005 | Moon et al. | |
| 7,475,517 | B2 * | 1/2009 | Kawai et al. | 52/702 |
| 7,543,411 | B2 | 6/2009 | Whitehead et al. | |
| 7,581,357 | B2 | 9/2009 | Richardson et al. | |
| 7,677,009 | B2 * | 3/2010 | Bowman | 52/641 |
| 7,877,936 | B2 | 2/2011 | Uffner et al. | |
| 7,891,144 | B2 * | 2/2011 | Gilstrap et al. | 52/92.2 |
| 7,980,029 | B2 * | 7/2011 | Ahmedy | 52/71 |
| 8,650,807 | B2 * | 2/2014 | McKimmy et al. | 52/79.9 |
| 2002/0116891 | A1 * | 8/2002 | Waldrop | 52/632 |
| 2002/0116893 | A1 * | 8/2002 | Waldrop | 52/731.4 |
| 2003/0000154 | A1 | 1/2003 | Ignazio | |
| 2003/0014927 | A1 | 1/2003 | Brooks | |
| 2003/0140573 | A1 | 7/2003 | Marcinkowski et al. | |
| 2004/0187402 | A1 | 9/2004 | Moon et al. | |
| 2005/0120641 | A1 | 6/2005 | Whitehead et al. | |
| 2005/0223652 | A1 | 10/2005 | Mower et al. | |
| 2007/0044391 | A1 | 3/2007 | Richardson et al. | |
| 2007/0151200 | A1 * | 7/2007 | Madray | 52/739.1 |
| 2007/0175108 | A1 | 8/2007 | Stein et al. | |
| 2008/0083189 | A1 * | 4/2008 | Dulac | 52/646 |
| 2008/0184651 | A1 * | 8/2008 | Bowman | 52/645 |
| 2008/0222989 | A1 * | 9/2008 | Greeff et al. | 52/641 |
| 2009/0308016 | A1 * | 12/2009 | Strickland et al. | 52/636 |
| 2013/0118110 | A1 * | 5/2013 | Davies | 52/641 |
| 2013/0263548 | A1 * | 10/2013 | Merrifield | 52/646 |
| 2014/0076370 | A1 * | 3/2014 | De Villenfagne De Sorinnes et al. | 135/122 |
| 2014/0157714 | A1 * | 6/2014 | Richardson | 52/646 |
| 2014/0283463 | A1 * | 9/2014 | Vogler et al. | 52/79.1 |
| 2014/0283464 | A1 * | 9/2014 | Vogler et al. | 52/79.5 |
| 2015/0023797 | A1 * | 1/2015 | Egbert | 416/223 R |

* cited by examiner

COLLAPSIBLE ROOF TRUSS ASSEMBLY AND METHOD

PRIORITY CLAIM

In accordance with 37 C.F.R. 1.76, a claim of priority is included in an Application Data Sheet filed concurrently herewith. Accordingly, the present invention claims priority to U.S. Provisional Patent Application No. 61/801,141, entitled "ROOF TRUSS ASSEMBLY AND METHOD", filed Mar. 15, 2013. The contents of the above referenced application is incorporated herein by reference.

FIELD OF THE INVENTION

The present invention relates to a roof truss and method of assembly. The truss is particularly adapted for use in a portable shed.

BACKGROUND OF THE INVENTION

The present invention relates to a roof truss and method of assembly. In the past, when so called portable sheds were sold, they came as a kit to be assembled by the purchaser. Typically, the walls, roof and floor components were of a molded polymeric construction. Molding could be by rotational molding or blow molding, allowing these components to be hollow and therefore light in weight while providing good weather resistance, structural strength and integrity.

It was desirable to provide such storage sheds with a peaked roof to support the weight of such things as snow, and to resist the impact of falling items. Further, to ease assembly, the roof was comprised of a plurality of segments which, to improve structural integrity, utilized trusses typically made of metal. While a truss could be provided pre-assembled, it was desirable to facilitate packaging and shed assembly, therefore, the truss would be provided in a plurality of pieces which meant that the purchaser had to assemble the parts to form the truss assembly. This meant that parts had to be provided to join the truss parts together and these parts would typically include bolts, washers and nuts. Multiple tools would also be needed to effect assembly. Oftentimes, parts would be missing or would be lost during assembly causing consumer dissatisfaction. Additionally, the more parts, the more time assembly took. Experience has shown that a truss that is completely assembled by a consumer can take 20-30 minutes to assemble.

Thus, it is desirable to provide an improved truss that is easier to assemble with fewer parts while preserving effective packaging. The inventive truss can be assembled in under 5 minutes.

SUMMARY OF THE INVENTION

The present invention involves the provision of a truss assembly which includes components that have segments pre-connected in a manner that allows the connected parts to be collapsed for packaging and shipping with the other components of a shed or the like.

The present invention also involves the provision of a method of assembling a truss.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

BRIEF DESCRIPTION OF THE FIGURES

FIG. 3 is an enlarged perspective view of a portion of an inclined run portion of the truss assembly showing a side adapter used to secure the truss to a shed or the like.

DETAILED DESCRIPTION OF THE INVENTION

Figure 1:
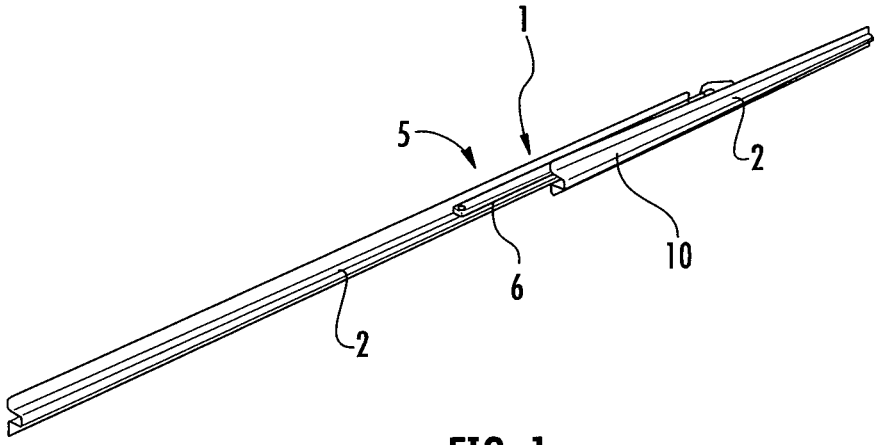
FIG. 1 is a perspective view of a truss assembly as configured in a collapsed condition for packaging.
Figure 2:
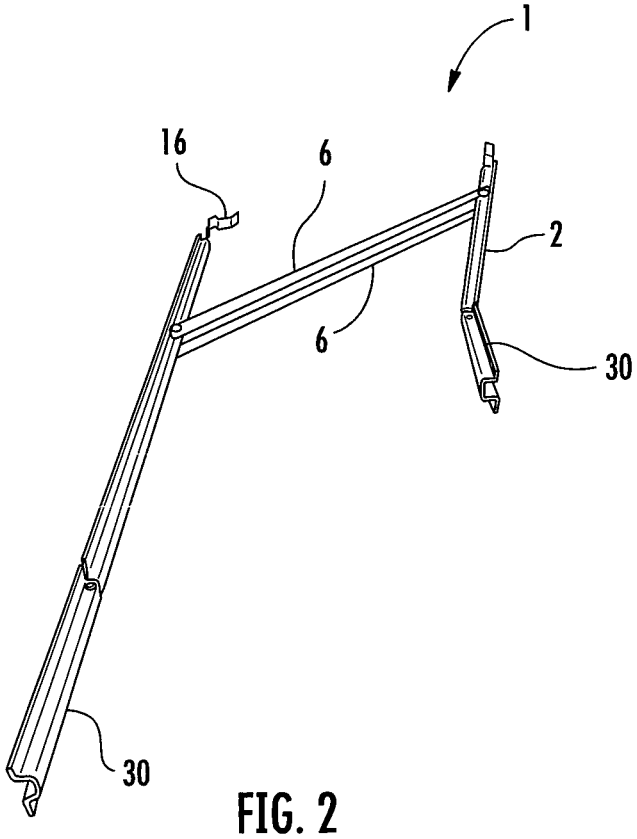
FIG. 2 is a perspective view of a truss assembly in an expanded configuration in preparation for assembly.

Referring to FIGS. 1-9, the inventive collapsible truss assembly 1 includes a pair of beam runs or legs 2 that, when assembled and in use, will be inclined. Words of orientation as used herein like "inclined" and "horizontal" are used in the sense of when the assembled truss will be in an orientation of normal use in a shed 3. The truss assembly 1 in use will be in the form of a downwardly opening V with an upwardly positioned apex 4 at the attached ends of runs 2. The truss 1 includes a horizontal cross brace run or beam 5 connected to and extending between the runs 2 intermediate opposite ends of the truss 1. The brace run 5 is a cross brace used to keep the runs 2 from moving apart in use and normally would be in tension, reducing the concern of their deformation from columnar effect bending if in compression. As such, a preferred form of run 5 is a pair of spaced apart separate brace members 6 each having an end portion positioned on the outside of and connected to a respective run 2 with a respective fastener 7 as described below. The brace members 6 are in laterally spaced apart relationship and have the runs 2 positioned there between when the truss 1 is in a collapsed configuration as seen in FIG. 1. The connection of the brace members 6 to the runs 2 are made before packing the truss assembly for distribution, forming a pre-assembly. The brace members 6, as shown, are flat straps laterally spaced apart. They may be made by stamping, roll forming or extrusion, and are preferably of a metal alloy such as steel or aluminum alloy. When the truss 1 is folded (collapsed) for packaging and shipping, portions of the runs can fit in the space between the brace members 6 and lie substantially parallel to one another with the bight sections 10 in engagement with one another as seen in FIG. 1.

The inclined truss runs 2 are preferably of similar size, shape and construction. As shown, the runs 2 each have an open side opposite a bight section 10 to facilitate assembly of the truss 1. As shown, the runs 2 each have a generally U shaped transverse cross-section and open outwardly. The runs 2 can be made in a manner similar to the brace members 6. The runs 2 each have the bight section 10 with a pair of legs 12, each extending from opposite longitudinal edges of the bight 10. Outwardly extending flanges 14 can be provided at the open side edge of each of the legs 12 and are preferably coplanar to assist in securing roof sections 15 to the truss 1, as with screws. Apertures 13 may be pre-formed in the flanges 14 to facilitate the securement of a roof panel to the truss. The open side of a run 2 facilitates the use of mechanical fasteners 7, preferably of a permanently affixed type, to pivotally join the brace members 6 each to a respective leg 12 of each run 2. A permanent fastener is one of a type that, during normal use, will not separate and permit failure of the connection. A preferred form of permanent fastener 7 is a rivet that has a formed head on each end. The use of rivets allows for loading of the rivet to produce some friction between the brace members 6 and the respective run 2 if desired. Rivets do not come apart as a nut and bolt might, but nuts and bolts and other suitable mechanical fasteners can be used. When the truss 1 is assembled, the brace members 6 and apex 4 end portions of the runs 2 form a triangle or three sided structure which is an inherently rigid structure.

Figure 8:
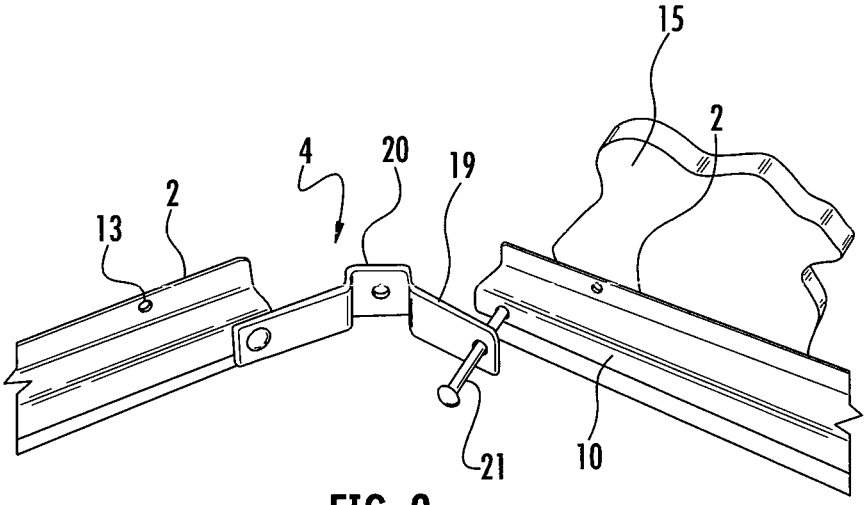
FIG. 8 is a further enlarged perspective view similar to FIG. 7 to illustrate details of the connector and apex end portions of the inclined runs as assembled and illustrating a portion of a roof panel.
Figure 9:
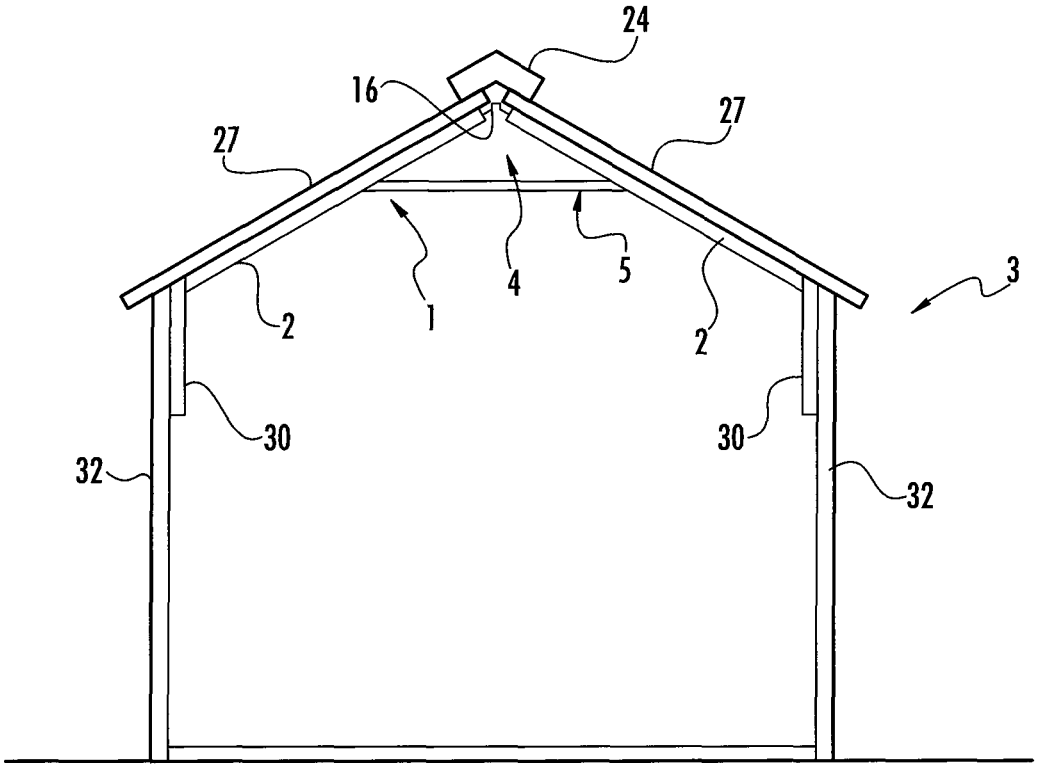
FIG. 9 is a side elevation schematic illustration of the inventive truss installed in a portable shed.

The truss 1 includes a bridging connector 16 operable for effecting connection of apex 4 end portions of the runs 2 together. See FIGS. 7, 8. The connector 16 is pre-connected, i.e. before packaging, to one of the runs 2 with a suitable mechanical fastener 17, preferably of the permanent type. It is to be understood that this connection could be as by welding or the like, but a pivotable connection is preferred. As shown, the connector 16 is secured to a bight section 10 of a respective run 2 and resides in the channel formed by the bight 10 and respective legs 12. Alternatively, the connector 16 can be secured to the bight section 10 on the outside of a respective run 2. The connector 16, as shown, has a pair of arms 18, 19 extending laterally from a center section 20 which are positioned relative to one another at the anticipated angle of the apex 4 and are received in the channel defined by a bight 10 and legs 12. One arm 18 is connected with the fastener 17 which, like the fastener 7, is a rivet with formed heads. As best seen in FIG. 8, the arm 19 is connected to its respective run 2 by the consumer, but with a mechanical fastener 21 by extending the fastener 21 through aligned apertures 22, 23 in the arm 19 and bight 10 respectively. The arm 19 is connected to its run 2 at its bight 10. This is the only connection that the consumer or assembler needs to make after removal of the truss 1 from its container; all others are made at the factory for assembly of the truss. A preferred fastener 21 is of a non permanent type such as a nut and bolt. The connector 16, in a preferred embodiment, is provided with means to effect securement of a roof ridge cap or cover 24 to it for covering the gap between roof panels 27 at the roof apex. As shown, center section 20 is in the form of a riser with a thru aperture adapted to accept a mechanical fastener therethrough to secure a ridge cap in place.

Figure 3:
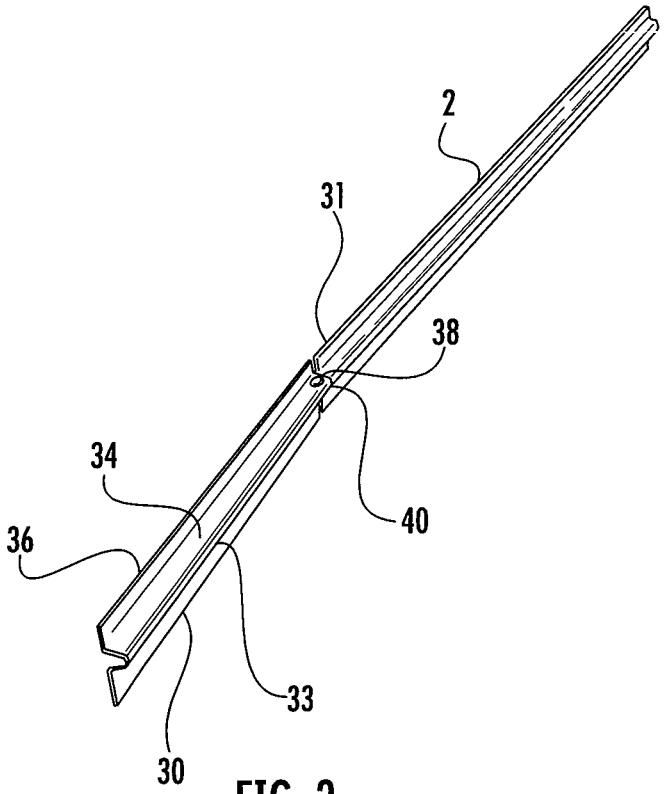
Figure 4:
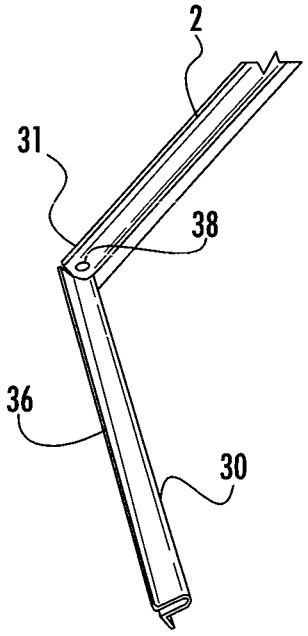
FIG. 4 is an enlarged perspective view of a portion of an inclined run portion of the truss assembly showing a side adapter as in FIG. 3 but with the side adapter in a further pivoted position.
Figure 5:
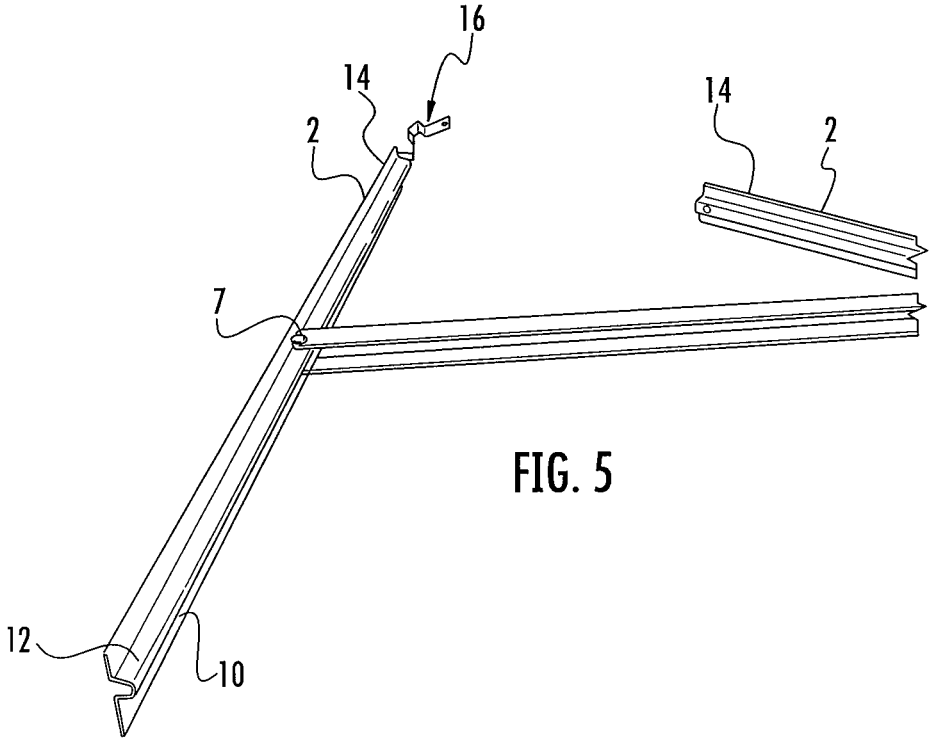
FIG. 5 is an enlarged perspective view of a portion of the truss assembly to illustrate details of a cross brace and connecter to connect two inclined runs together to form the truss peak.
Figure 6:
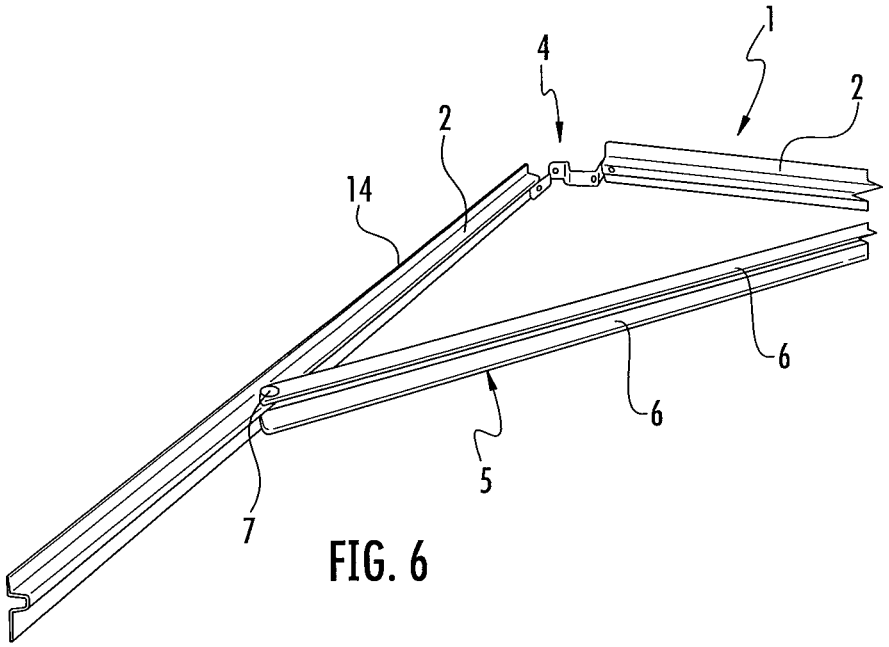
FIG. 6 is an enlarged perspective view of a portion of the truss assembly similar to FIG. 5 but showing the two inclined runs closer to connecting the inclined runs together.
Figure 7:
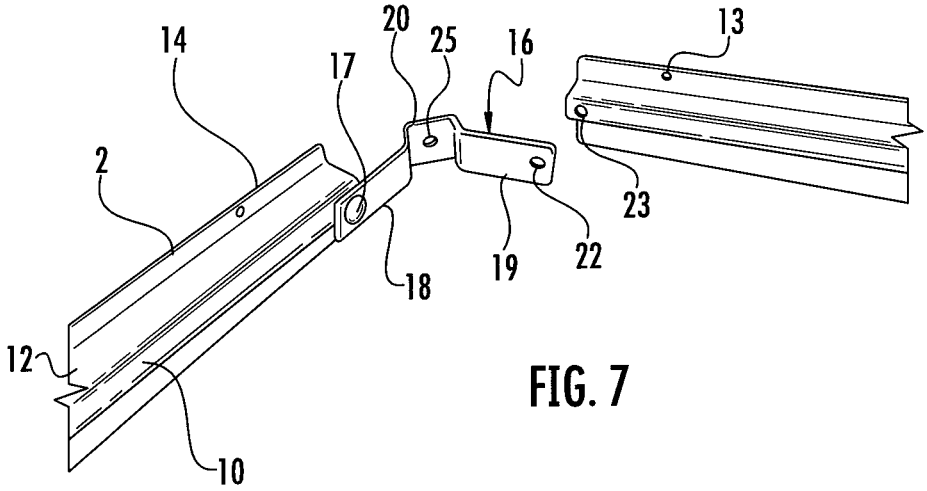
FIG. 7 is a further enlarged perspective view to illustrate details of the connector and apex end portions of the inclined runs.

In a preferred embodiment, and as seen in FIGS. 3, 4, the truss 1 is provided with side adapter members designated as 30. A side adapter member 30 is pivotally connected to each of the runs 2 at their free end 31. Preferably, they are made in the same form as the runs 2 and have a bight 33 and legs 34 extending therefrom. They can have outwardly extending flanges 36 similar in construction to the flanges 14 with apertures to facilitate connection to a shed sidewall 32 or the like. The side adapters 30 also have a generally U shaped cross-section and can be formed as are the brace members 6 and the runs 2. In a preferred embodiment, a side adapter 30 is connected to a respective run 2 with a pair of permanent mechanical fasteners 38 like rivets with formed heads. The connection of the side adapters 30 to the runs 2 is made prior to packaging for shipping. A notch 40 can be provided on the attached end of a side adapter 30 to permit it to pivot relative to a respective run 2.

The truss 1 is assembled after removal of the pre-assembly from the consumer package. When the truss 1, its brace members 6, and the side adapters 30 are moved relative to the runs 2, they move in generally parallel planes. The pre-assembly has it parts expanded from nested together in the collapsed configuration by pivoting each of the brace members 6 about their respective fasteners 7. When the trust 1 is in its collapsed configuration, the runs 2 are substantially parallel with the bight sections 10 being in contact with one another. The two apex ends of the runs 2 are moved adjacent one another until the apertures 22, 23 are aligned. The fastener 21 is extended through the apertures and secured in place. The truss 1 is then suitably secured to the roof panels 27, cap 24 and preferably the sidewalls 32 adjacent interior surfaces thereof with suitable fasteners such as screws.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A collapsible roof truss adapted for use in building a shed, the truss including:

a pair of beam runs each having an apex end portion and a free end portion;

a brace run having opposite ends and being pivotally connected to each of the beam runs intermediate of and between a respective said apex end portion and respective said free end portion allowing the beam runs to be moved between a collapsed configuration and a position allowing the apex end portions to be selectively secured together to form a triangle;

a connector having a first arm permanently secured to one said beam run apex end portion, said connector having a center section connected to the first arm and having a second arm, the second arm adapted to be secured to the other beam run apex end portion, said center section being configured to be between said apex end portions when the truss is assembled for use and said first and second arms being positioned relative to one another at an anticipated apex angle of the assembled truss; and a pair of side members each pivotally connected to a respective said beam run adjacent a respective said free end portion and configured for securement to a shed portion of the shed.

2. The truss of claim 1 wherein the beam runs each having a generally U shaped transverse cross-section including a bight section and a pair of leg portions extending from opposite edges of the bight section, said brace run opposite ends having portions thereof each being pivotally secured to a respective said leg portion adjacent thereto and positioned on the outside thereof.

3. The truss of claim 2 wherein said center section including a riser, one of said arms being permanently secured to the bight section of one said beam run and the other said arm being adapted to be secured to the bight section of the other said beam run.

4. The truss of claim 2 including a plurality of mechanical fasteners each forming said pivotal connection between the brace run and respective beam runs and between the side members and respective beam runs.

5. The truss of claim 2 wherein the first and second arms each extending laterally from said center section, said first and second arms being positioned relative to one another at the apex angle substantially between apex end portions of the beam runs when the truss is assembled for use, said first and second arms each being received in a respective channel defined by a respective said bight section and respective said leg portions of one said beam run.

6. The truss of claim 2 wherein the connector being secured to each of the beam runs and forming a truss assembly with the apex end portions and brace run forming the triangle, said truss assembly being secured to roof panels and sidewalls of the shed.

7. The truss of claim 2 wherein the brace run including a pair of spaced apart brace members each secured to a respective leg of each beam run.

8. The truss of claim 7 wherein when said truss is in the collapsed configuration, the said beam runs are substantially parallel to one another and have portions thereof positioned between portions of said brace members and each having a portion thereof overlapping one another.

9. The truss of claim 2 wherein each of said side members having a generally U-shaped transverse cross-section with a bight section and a pair of legs.

10. The truss of claim 9 wherein said beam runs and said side members each having at least one flange extending outwardly from a respective said leg.

11. A method of making a roof truss for a portable shed, the method including:

providing a pair of beam runs in a collapsed configuration each having an apex end portion and a free end portion and each pivotally connected to a brace run intermediate of and between a respective said apex end portion and respective said free end portion, one of said beam runs having a connector with first and second arms with said first arm being permanently secured to one of said apex end portions;

moving the beam runs relative to one another from the collapsed configuration wherein the apex end portion of the beam run with the connector secured thereto is positioned adjacent the apex end portion of the other beam run; and securing the connector second arm to the other beam run adjacent said apex end portion of said other beam run with a mechanical fastener to form a triangular structure between the beam runs and brace run.

* * * * *